US010127845B2

(12) United States Patent
Heiter

(10) Patent No.: US 10,127,845 B2
(45) Date of Patent: Nov. 13, 2018

(54) DRIVE ARRANGEMENT AND ROTATING MECHANISM FOR AN ADVERTISING OR INFORMATION MEDIUM HAVING A DRIVE ARRANGEMENT OF THIS TYPE

(71) Applicant: BAYER FEINWERK GMBH & CO. KG, VS-Villingen (DE)

(72) Inventor: Uwe Heiter, Tuningen (DE)

(73) Assignee: BAYER FEINWERK GMBH & CO. KG, VS-Villingen (DE)

( * ) Notice: Subject to any disclaimer, the term of this patent is extended or adjusted under 35 U.S.C. 154(b) by 129 days.

(21) Appl. No.: 14/786,081

(22) PCT Filed: Apr. 22, 2014

(86) PCT No.: PCT/EP2014/058161
§ 371 (c)(1),
(2) Date: Dec. 11, 2015

(87) PCT Pub. No.: WO2014/173913
PCT Pub. Date: Oct. 30, 2014

(65) Prior Publication Data

US 2016/0086523 A1 Mar. 24, 2016

(30) Foreign Application Priority Data

Apr. 23, 2013 (DE) ..... 10 2013 022 276
Apr. 23, 2013 (DE) ..... 10 2013 104 096

(51) Int. Cl.
*G09F 17/00* (2006.01)

(52) U.S. Cl.
CPC ..... *G09F 17/00* (2013.01); *G09F 2017/0025* (2013.01)

(58) Field of Classification Search
CPC ..... G09F 2017/0025; G09F 7/002; G09F 2007/183; G09F 15/0081; G09F 15/0087; G09F 15/0037; G09F 15/0075; G09F 2017/0058; G09F 2017/0041; G09F 2017/005
USPC ..... 40/601
See application file for complete search history.

(56) References Cited

U.S. PATENT DOCUMENTS 5,613,314 A * 3/1997 Leverenz ..... G09F 15/00 160/207
6,455,767 B1 * 9/2002 Muller ..... F21S 9/037 116/173
7,685,754 B1 * 3/2010 Torres ..... G09F 7/002 40/602
2008/0148613 A1 * 6/2008 Lefebvre ..... G09F 7/00 40/601

(Continued)

FOREIGN PATENT DOCUMENTS

CH 687936 A5 3/1997
DE 29813071 U1 11/1998

(Continued)

OTHER PUBLICATIONS

International Search Report for PCT/EP2014/058161 dated Aug. 8, 2014.

*Primary Examiner* — Kristina N Junge
(74) *Attorney, Agent, or Firm* — Bachman & LaPointe, PC

(57) ABSTRACT

A rotating mechanism characterized by a drive arrangement which provides rotating, hoisting and dropping functions with just a single drive.

10 Claims, 14 Drawing Sheets

(56) References Cited

U.S. PATENT DOCUMENTS

| | | | | |
|---|---|---|---|---|
| 2009/0145013 | A1* | 6/2009 | McCudden | E04H 12/32 40/601 |
| 2010/0058631 | A1* | 3/2010 | Oonishi | G09F 15/0056 40/582 |
| 2011/0314715 | A1* | 12/2011 | Tomacelli | G09F 15/0018 40/607.01 |

FOREIGN PATENT DOCUMENTS

| | | | |
|---|---|---|---|
| DE | 19906141 | A1 | 8/2000 |
| DE | 202008007013 | U1 | 8/2008 |
| JP | 2008191589 | A | 8/2008 |

* cited by examiner

DRIVE ARRANGEMENT AND ROTATING MECHANISM FOR AN ADVERTISING OR INFORMATION MEDIUM HAVING A DRIVE ARRANGEMENT OF THIS TYPE

BACKGROUND OF THE INVENTION

The present invention relates to a drive arrangement and a rotating mechanism for an advertising or information medium.

Numerous devices for fixing round flags, advertising banners and the like in various shapes and sizes are known.

For example, DE 20 2008 007 013 U1 describes a flag bearer with a rotating function, whereby the latter is achieved using an electric motor. The flag bearer is modular in the sense that it can be placed on known flagpoles.

Another path is taken by the invention described in DE 298 13 071 U1 in which the rotation is achieved by means of thermals, or more specifically by means of a ventilator inside a rotating display.

DE 199 06 141 A1 describes an advertising medium, the shape of which takes into account wind conditions. The object of the invention is to provide an advertising or information medium which is easy to read in both calm conditions and heavy winds. This object is achieved by designing the advertising medium in the shape of a rigid wing, which is easy to read when the weather is calm due to its rigidity and easy to read in heavy winds due to the advantageous shape.

The disadvantage of all known mechanisms of this type is the fact that they do not offer any protection against damage when the wind is strong. With the exception of its aerodynamic design, DE 199 06 141 A1 does not provide any protection against strong wind.

The object of the present invention is to overcome the disadvantages of the prior art. In particular, a mechanism is to be provided which can prevent damage to the round flag and/or the flagpole in the case of unfavourable weather conditions, especially strong wind. A mechanism should preferably further be provided which carries out the rotation of the round flag and any necessary measures to prevent damage, preferably independently.

SUMMARY OF THE INVENTION

The features of the present invention enable the object to be achieved. A mechanism for the rotation of an advertising or information medium of any shape, in particular a round flag, has a dropping function in order to avoid damage to the round flag and/or the flagpole or the flag mounting.

A mechanism in accordance with the invention typically has a rotating function for the advertising or information medium. In a preferred embodiment an electric motor is provided to achieve this rotating function. However, it is conceivable to use another motor, a ventilator or a thermal generated in another way or for example solar energy to achieve the rotation.

The dropping function in accordance with the invention is preferably activated in the case of strong winds without the assistance of a user. In a typical embodiment, a wind gauge is provided for this purpose which triggers a drop once a threshold value is exceeded.

The dropping function is preferably achieved in such a manner that the dropping can be carried out following an activation of the dropping function on the basis of the net weight of the advertising or information medium, in particular the round flag. However, in order to ensure the dropping of the advertising or information medium and/or the securing or storage of this after dropping, it is conceivable to use other elements or procedures not defined in greater detail here in addition to or instead of the net weight.

In an operating condition in which the advertising or information medium is hoisted, the latter is preferably held in the operating condition by means of one or more electromagnetic clamps. In this embodiment, the activation of the dropping function is achieved by means of switching off the electromagnet. Due to the use of an electromagnet, this dropping function is advantageously also activated in the case of a power failure. Of course any other holding mechanism which is suitable to be controlled and to enable the dropping function can also be used.

It should be noted at this point that the dropping function can also be realised in another manner. It is conceivable, for example, that the dropping of the advertising or information medium is not controlled once a detector has determined that a threshold value has been exceeded. Instead, the dropping can occur as a result of the strength of the wind itself. In this case, the mounting would be designed such that it no longer bears the advertising or information medium from a certain wind speed, resulting in a dropping in order to avoid damage. The dropping function could then be deemed to be a reversible predetermined breaking point to a certain extent.

Furthermore, it is also conceivable to combine a non-controlled mounting with a dropping function of this type with a controlled dropping function.

Furthermore, the dropping function can also be realised in the sense of a lowering or shortening function, for example if the advertising or information medium may be damaged as a result of being dropped. For example, a reversal of a hoisting function described below could be used to lower the advertising or information medium. Other means are also conceivable which are suitable to lower the advertising or information medium in as gentle a manner as possible after dropping.

In this procedure, the lowering or shortening function is preferably realised such that the advertising or information medium is moved in the direction of the ground on which the mast is standing if it is lowered or shortened. Alternatively or in addition to this, however, in another embodiment, it is conceivable that the lowering or shortening function draws in the advertising or information medium in a manner similar to that of a ship's sail, in other words along the mast in a position distant from the ground. This can, for example, serve to make the advertising or information medium inaccessible to unauthorised persons.

Shortening or lowering within the scope of the present invention therefore preferably means decreasing the surface of the advertising or information medium that is exposed to the weather conditions, in particular the wind conditions, when hoisted.

The present invention therefore comprises providing either a passive dropping function, in particular as a result of the net weight of the advertising or information medium, or an active dropping function in the sense of a lowering or shortening function. It is also possible to combine the active and passive dropping functions in a mechanism.

There should be no limits set on the shortening or lowering function within the scope of the present invention. It is therefore possible to provide the lowering or shortening function by means of a motor, in particular an electric motor, provided separately and solely for this function. It is also possible to provide the lowering or shortening function by means of the specific arrangement of the components and devices responsible for the hoisting function described below. With regard to this, tapes can be considered in particular which are fixed to the advertising or information medium such that they enable a sail-like shortening.

The hoisting function is further provided in a typical embodiment. By means of an appropriate design of the hoisting function, for example using the sensors, position measurement devices or the like described in greater detail below, this can be used, following successful dropping, shortening or storage of the advertising or information medium, to place the latter in the operating condition.

In a typical embodiment, hoisting of the advertising or information medium is carried out by means of the hoisting function by means of said advertising or information medium being drawn upwards, whereby an electronic system equipped with sensors monitored whether it reaches the upper end position in a predetermined, adjustable amount of time. If this is not the case, it is conceivable in particular to activate the dropping function and immediately afterwards the hoisting function. On the second attempt to hoist the advertising or information medium, the electronic system is used to determine whether the predetermined upper end position is reached within the time set out. If the upper end position is once again not reached, the mechanism preferably switches off entirely.

The design of the drive unit in accordance with the invention ensures that the rotating function is inactive while the hoisting function is active. Furthermore, targeted switching off is used, in particular on the part of the electronic system, to ensure that the rotating function and the hoisting function are inactive during a dropping process.

In accordance with an embodiment, drive unit refers to all parts of the mechanism with the exception of a base or a base part to be described below.

It is conceivable to design the number of motor rotations to be adjustable. Furthermore, it is conceivable to design the number of motor rotations to be different for the various functions and adjustable.

If the upper end position is not reached, there is no reversal of the direction of the motor.

The hoisting function is preferably activated when the wind speed threshold value falls below a certain point.

The embodiments described above are suitable, individually or in appropriate combination, to protect advertising or information media, in particular round flags and/or flagpoles or other mountings of advertising or information media and the like from damage caused by strong winds. In a preferred embodiment, the dropping function is activated when the wind speed exceeds a certain level. The advertising or information medium is dropped, protecting it from damage. If the wind gauge provided registers the wind speed falling below a certain point after dropping, the hoisting function is activated and the advertising or information medium is returned to the operating condition.

The mechanism is therefore always capable of guaranteeing a promotionally effective presentation of the advertising space when the wind speed is below a threshold value, above which damage can be expected. In other words, a mechanism in accordance with the invention is capable of ensuring the presentation of the advertising space over a maximum period of time while simultaneously minimising the risk of damage caused by strong winds.

Of course it is also conceivable to adjust the wind gauge or in particular the threshold values to local conditions. When doing this, the shape, design and stability of the advertising or information medium and/or the flagpole or mounting to which it is assigned and the typical wind and weather conditions at the location of the advertising or information medium can all play a role. Furthermore, the wind gauge can be designed such that the threshold values may not be exceeded or fallen below over a specific period of time in order to activate the drop or hoisting function. In this way, it is possible to avoid the dropping and/or hoisting functions from being frequently activated one after the other in the case of wind strengths that fluctuate about at least one of the threshold values set over a long period of time.

It is further conceivable to use other sensors, for example rain or light sensors. When using these sensors, the focus can be on both advertising and safety. In terms of advertising, it is conceivable to present an advertisement for ice cream only when the sun is shining and to drop this when it is raining. In terms of safety, it is conceivable to activate the dropping function when it is raining. When doing this, it is necessary to take into account that rain will not damage the advertising or information medium, but strong winds often follow rain and these may damage the advertising or information medium.

If the wind gauge is damaged, for example as a result of hail or other weather conditions, a movement sensor assigned to the flagpole can contribute to the safety of the advertising or information medium. If the wind gauge is damaged and can therefore no longer register strong winds, the flag will remain hoisted even in strong winds. The energy in the wind which strikes the flag will also move the flagpole or shake the mast. This shaking is then registered by the movement sensor, in turn leading to an activation of the dropping function. A drop triggered by the movement sensor on the mast should preferably occur even if the wind gauge does not rotate, for example as a result of damage. The idea here is that the electronic system checks whether the wind gauge is rotating if there is any shaking.

The idea is also that the dropping function will also be activated if the motor is braked too sharply while the rotating function is active. This can be as a result of various external influences, with the advertising or information medium being held on to by children who are playing or catching on trees or bushes being named here by way of example.

In a preferred embodiment of the mechanism in accordance with the invention, just one drive unit, in particular just one motor, is provided to supply the rotating function and the hoisting function. In this way, a mechanism which is as efficient as possible in terms of space and cost can be realised. However, it is also conceivable to provide several drive units for the various functions without straying from the nature and scope of the invention.

In an embodiment of the mechanism with just one drive units, gears are preferably provided for the use of a motor torque for the hoisting and rotating function. Several functions of the mechanism and the associated gears can be driven in a simple manner by a single motor shaft by means of a coupling, for example an electromagnetic coupling, a ball catch and/or freewheel bearings. The gears which are used can for example be epicyclic or bevel gears.

The hoisting function is not required on a sustained basis in a typical embodiment. The gears that are responsible for the hoisting function are therefore advantageously connected to the motor shaft by means of the coupling, in particular the electromagnetic coupling or the ball catch.

In a preferred embodiment, the gears, which are often active over extended periods of time and which are assigned to the rotating function, are connected to the motor shaft by means of a freewheel bearing. The direction of rotation of the motor can therefore be used to control whether the rotating function is active.

However, other types of torque transmission or quick-break are also conceivable instead of the gears and the coupling described above.

The mechanism in accordance with the invention does not depend on the design of the advertising or information medium. The latter are therefore also conceivable in many known and other forms, sizes etc., for example in the form of conventional flags of any dimensions, in the form of packaging such as drinks containers or in the form of another product to be advertised.

The mechanism is preferably designed such that it is suitable to be assembled on, for example, existing flagpoles or the like in a simple manner.

The mounting of the parts of the mechanism which rotate relative to one another can be carried out in various ways. In addition to a ball bearing, a plain bearing should for example also be covered by the present invention.

BRIEF DESCRIPTION OF THE DRAWINGS

Further advantages, features and details of the invention arise from the description of preferred embodiments and the drawings in which.

DETAILED DESCRIPTION

Figure 1:
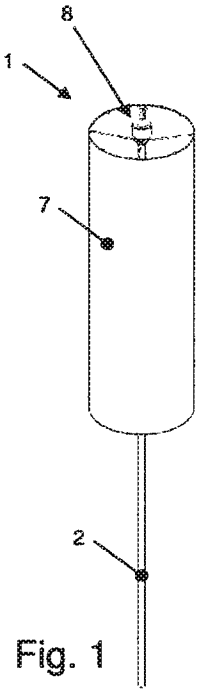
FIG. 1 is a perspective view of an advertising or information medium with an assigned rotating mechanism when hoisted.

FIG. 1 shows an advertising or information medium 1 when hoisted. The drive unit 8 is at an upper end of the mechanism. Furthermore, an advertising space 7 and a flagpole 2 can be identified.

Figure 2:
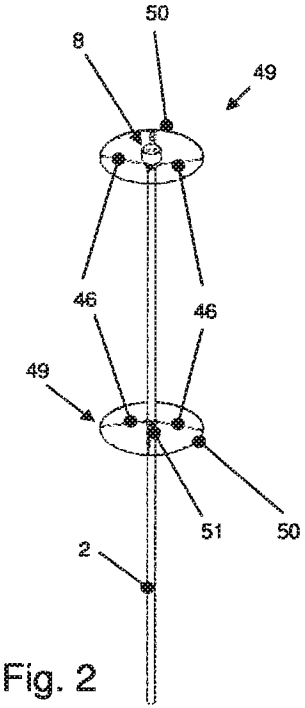
FIG. 2 is a perspective view of a rotating mechanism in accordance with FIG. 1 without the advertising space.

FIG. 2 shows a rotating mechanism 49 mounted on the flagpole 2 without an advertising space fixed to it. The fixing devices 50 on the rotating mechanism side can easily be identified. They are connected to the drive unit 8 or to a retaining ring 51 by means of struts 46.

Figure 3:
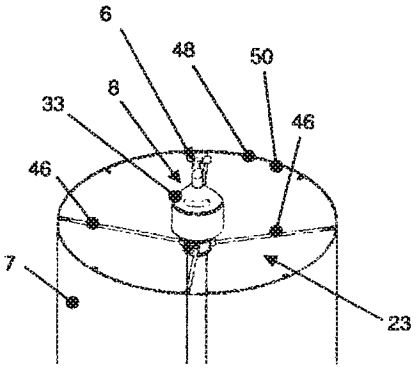
FIG. 3 is a perspective partial view of the advertising or information medium in accordance with FIG. 1 when hoisted.

The partial view shown in FIG. 3 shows an upper part of the advertising or information medium when hoisted. The advertising space is connected to the rotating mechanism by means of a fixing device 48 on the advertising space side via the fixing device 50 on the side facing the direction of rotation. The fixing device is in turn fixed to the upper lifting part 23 by means of struts 46. A wind gauge 6 is further mounted on an upper end of a cover of a drive unit 8.

Figure 4:
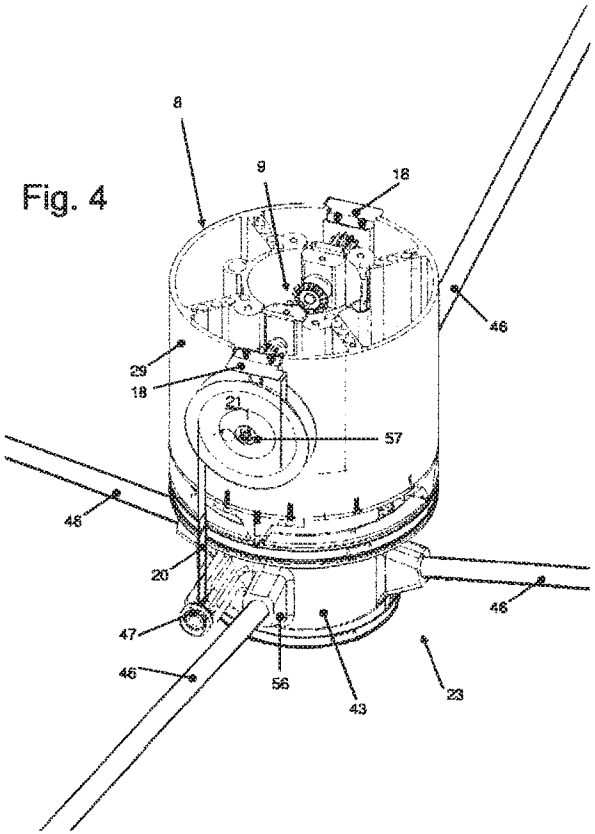
FIG. 4 is a partial section through a perspective partial view of a drive unit and a lifting part when hoisted.

FIG. 4 shows a drive unit 8 without a cover and an upper lifting part 23. The upper lifting part 23 is in an upper end position, so the rotating mechanism, shown here merely in section, is hoisted. The drive unit 8 and the upper lifting part 23 are connected to one another via two tapes 20. The tapes 20 are fixed to a mounting 47 which is fixed to the receiving ring 43. Two rolls 21 on the outside of a roll mount 29 on the drive unit 8 mount the tapes 20 at opposite ends, A retaining clip 18 is assigned to each of the rolls 21. The rolls are each mounted on a shaft 57 which passes through the roll mount 29. The shaft 57 is assigned to a bevel gear 9 inside the drive unit 8.

It should be noted here that the present invention is not limited to an embodiment with two tapes. Rather, the provision of just one tape and the provision of more than two tapes should also be covered by the present invention. Instead of tapes, ropes and/or cords, for example, which carry out the function of the tapes can be considered.

Recesses 56 are moulded into the receiving ring 43 of the upper lifting part 23. Starting from the recesses 56 and mounted in these the lifting part has struts 46.

Figure 5:
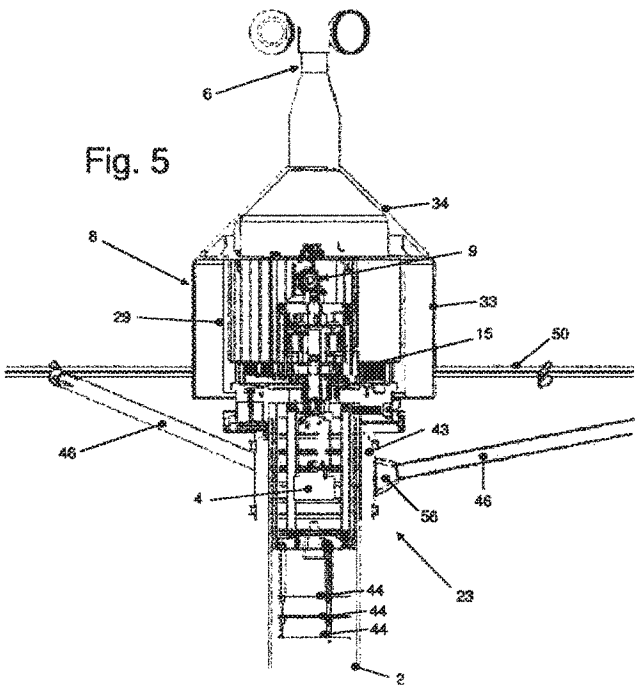
FIG. 5 is a side view of a drive unit and a lifting part when hoisted.

FIG. 5 shows a section through a side view of the mechanism. The upper lifting part 23 is in the upper end position, the rotating mechanism is therefore hoisted. At an upper end of the drive unit 8 the mounting base 34 with the wind gauge 6 placed on it can be identified. A cover 33 which encloses the roll mount 29 is also shown. In the inside, the planetary gears 15 and the bevel gears 9 are shown. There is an electric motor 4 underneath the gears 9, 15. Control units can be seen underneath the electric motor 4.

Struts 46 mounted in recesses are fixed on the receiving ring 43 of the upper lifting part 23. The struts 46 bear the fixing device 50 on the side on which the rotating mechanism is arranged.

Figure 6:
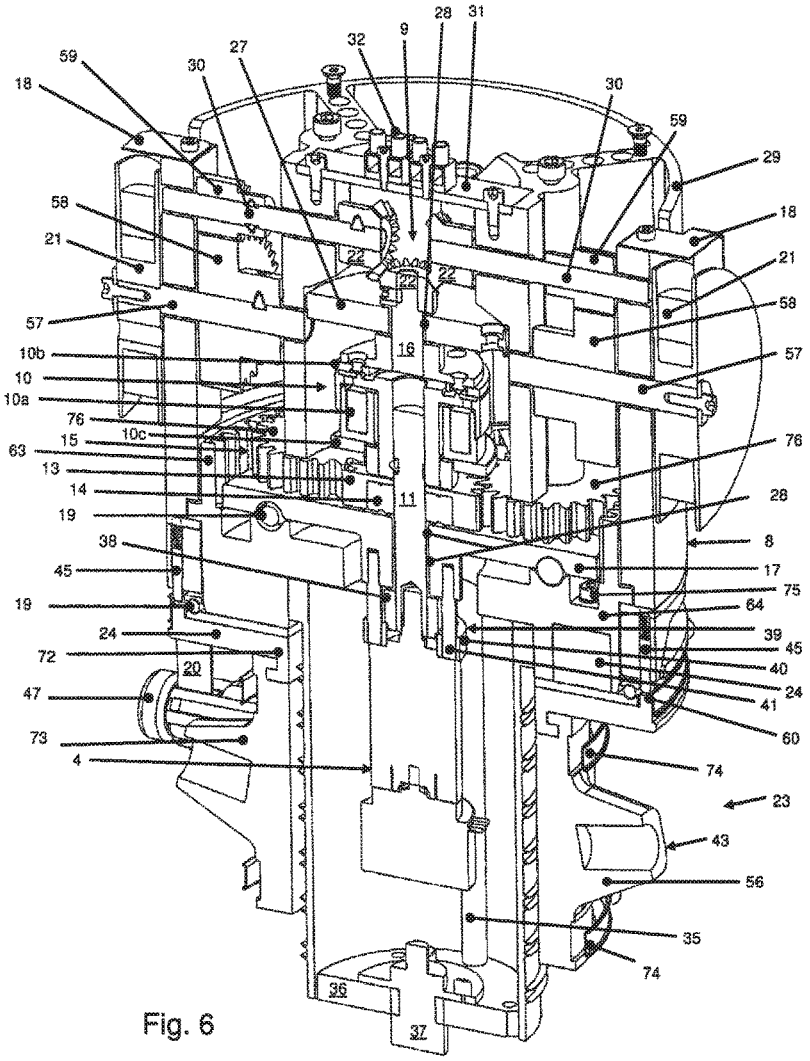
FIG. 6 is a section through a perspective view of a drive unit and a lifting part when hoisted.

FIG. 6 shows a section through a perspective view of the drive unit 8 with the upper lifting part 23 without a cover.

The receiving ring 43 comprises a first half shell 72 and a second half shell 73. Pipe clamps 74 are also provided.

A mounting plate 31 is arranged in the centre at the top on the roll mount 29 with a luster terminal 32 fixed on said mounting plate.

Two opposing rolls 21 are arranged on the outside of the roll mount 29. The rolls 21 are each mounted on a shaft 57, whereby the shaft passes through the roll mount 29. Inside the roll mount 29, a gear wheel 58 is assigned to each shaft, with each gear wheel meshing with a further gear wheel 59. In this arrangement, the gear wheel 59 is mounted on the drive shaft 30 of the bevel gear 9. A bevel wheel 22 is mounted on an end of the drive shaft 30 which is opposite the end which bears the gear wheel 59. The bevel wheels 22 of both drive shafts 30 are meshed with a further bevel wheel 22 mounted on the end of a coupling shaft 16. The coupling shaft 16 is mounted in an anchor sub-plate 27 by means of a plain bearing 28.

The coupling shaft 16 is connected to the motor shaft 11 by means of an electromagnetic coupling 10. The electromagnetic coupling 10 has an anchor part 10*a*, a rotor 10*b* and a support disc 10*c*. The motor drive 11 is further connected to the electric motor 4 by means of a motor coupling 38. A motor torsion protection 39, an adapter ring and a torsion pin 41 are assigned to the electric motor 4. The motor shaft 11 is mounted on a web 17 and the coupling shaft 16 is mounted on an anchor sub-plate 27 by means of a plain bearing 28.

The sun wheel 13 of the planet gear 15 is mounted on the motor shaft 11. A freewheel bearing 14 is pressed onto the sun wheel 13.

There is a slipring enclosure 37 underneath the electric motor 4, which slipring enclosure is fixed on an anchor sub-plate 36. Mounting on the anchor sub-plate 36 on the base part 64 is achieved by means of spacing rollers 35.

The upper lifting part 23 has a receiving ring 43 with recesses 56 for the struts. A mounting 47 is also moulded to it to fix the tape 20. Electromagnetic clamps attached to the base part 64 by means of a screw 75 come into contact with the upper end position of the upper lifting part 23 of the drive unit 8 shown in FIG. 6. Furthermore, in the upper end position pins 45 in the drive unit 8 mesh with pin recesses 60 in the lifting part.

FIGS. 13 to 16 show an alternative embodiment in which the coupling 10 is replaced by a ball catch 76. In this embodiment, the bevel wheel 22.2 is mounted on the end of the motor drive 11.2 and no coupling shaft 16 is provided. The bevel wheel 22.2 which is mounted on the end of the motor shaft 11.2 is meshed with two bevel wheels 22.2 which are placed on end of two drive shafts 30.2. A roll 21.2 is placed on the other end of the two drive shafts 30.2. As can clearly be seen in FIGS. 15 and 16, the ball catch 76 comprises a ring adapter 77 with ball pans 78, four balls 79, one ball mount 80, one anchor 81 with recesses 84 and a surrounding overhang 87 and a torsion plate 82. The bevel wheel 22.2 placed on the end of the motor shaft 11.2 is connected to the ring adapter 77 by means of three screws. An electromagnetic clamp 24.2 is arranged above the torsion plate 82.

Figure 7:
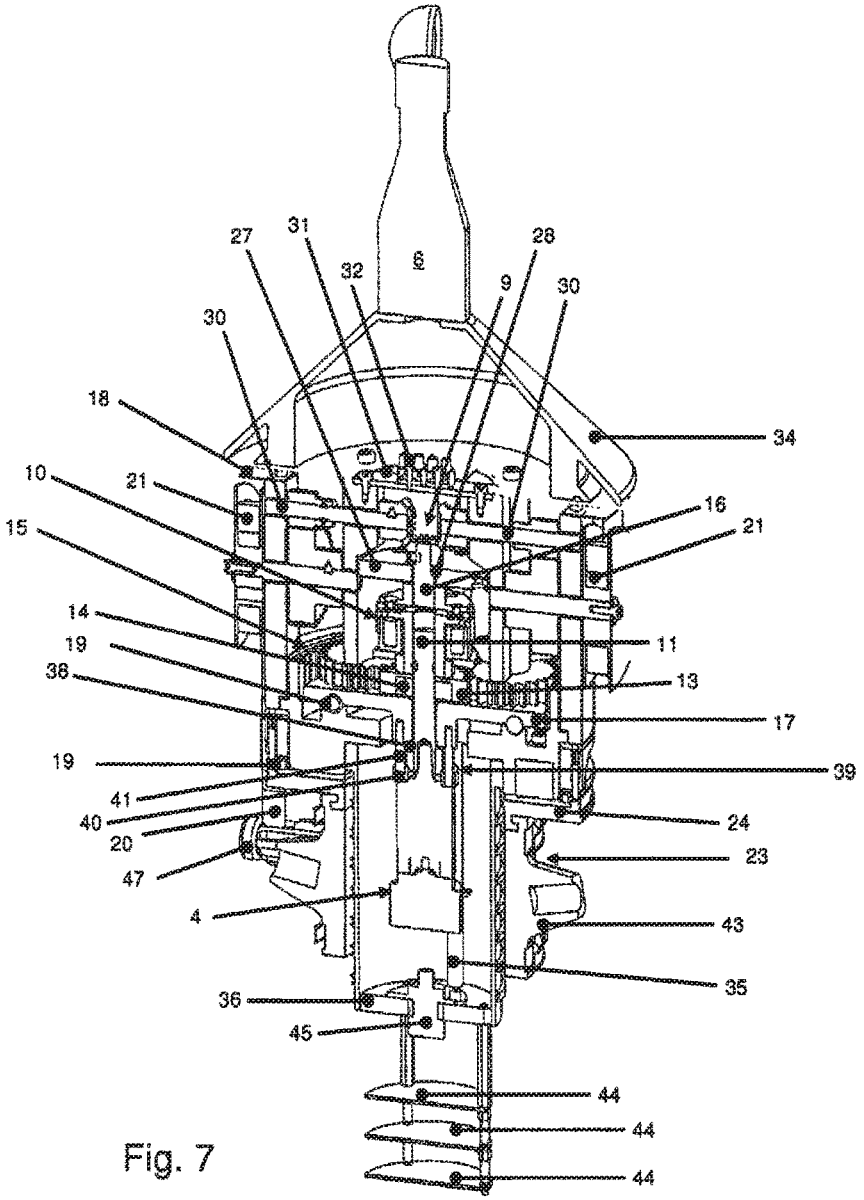
FIG. 7 is a section through a perspective view in accordance with FIG. 6 but with a wind gauge and control units.

FIG. 7 shows a section through a perspective view of the rotating mechanism with a mounting base 34, wind gauge 6 and control units 44.

Figure 8:
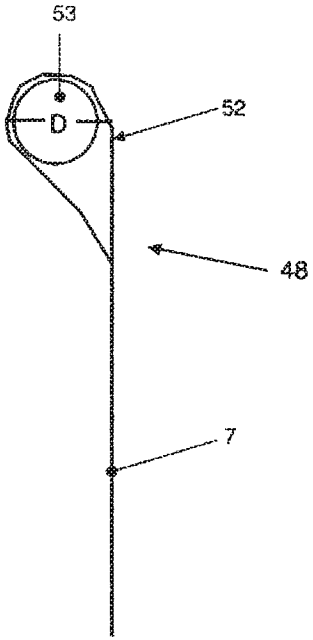
FIG. 8 is a perspective partial view of a fixing mechanism on the side facing the direction of rotation and a side view of a fixing mechanism on the advertisement side.
Figure 8:
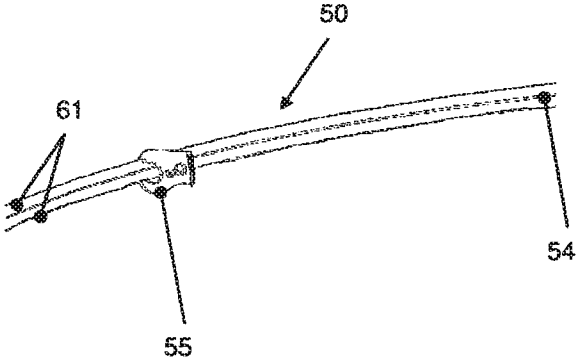

FIG. 8 is a perspective partial view, not to scale, of a fixing device 50 on the side on which the rotating mechanism is arranged and a side view of a fixing device 48 on the advertising space side. The fixing device 50 on the side on which the rotating mechanism is arranged comprises two rings 61, the position of which relative to one another is determined by means of retaining clamps 55. The fixing device 48 on the advertising space side comprises an end region of a round flag 7. This end region is sewn into a surrounding loop 52, whereby the loop 52 contains a hose, for example a pneumatic hose 53.

Figure 9A:
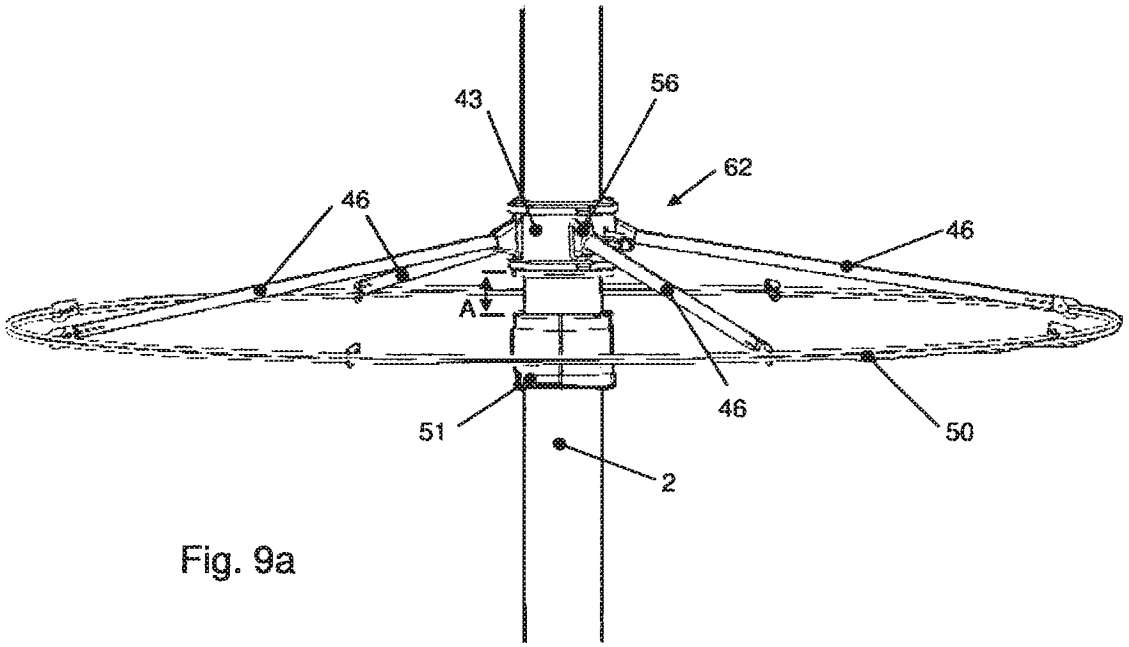
FIG. 9*a* is a perspective view of a lower end of the rotating mechanism.

FIG. 9*a* shows a lower end of the rotating mechanism without a cloth when hoisted. A retaining ring 51 is attached to the mast 2 below the lower lifting part 62. There is a distance A between the lower lifting part 62 and the retaining ring 51. The lower lifting part 62 comprises two receiving rings 43 with recesses 56 to fix the struts 46. In turn, the struts 46 bear the fixing device 50 on the side on which the rotating mechanism 50 is arranged.

Figure 9B:
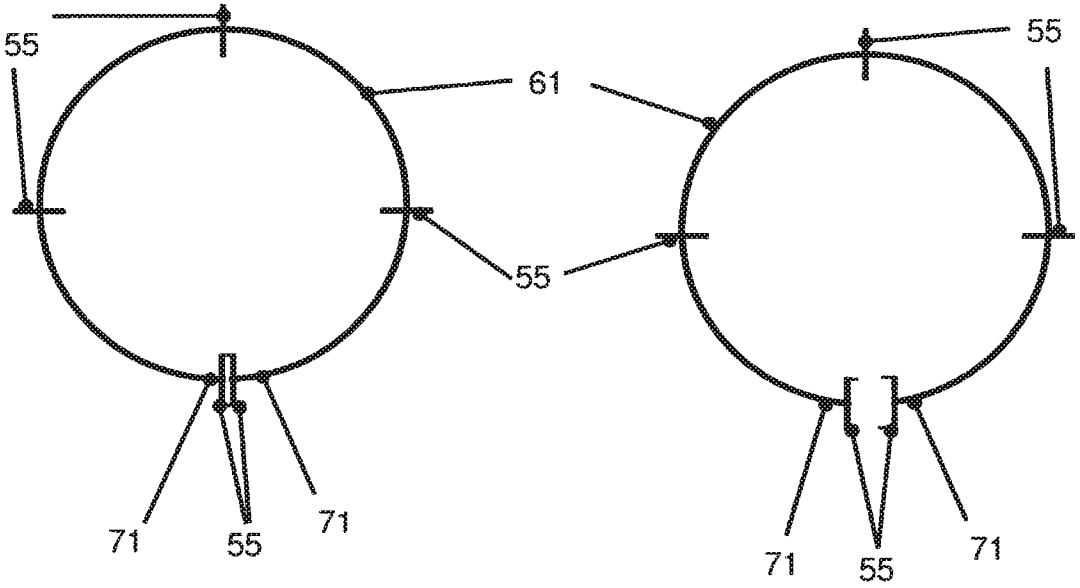
FIG. 9*b* is two schematic partial views in accordance with FIG. 9*a;*

FIG. 9*b* is a schematic view of the two rings 61 with retention clamps when closed and when open.

Figure 10:
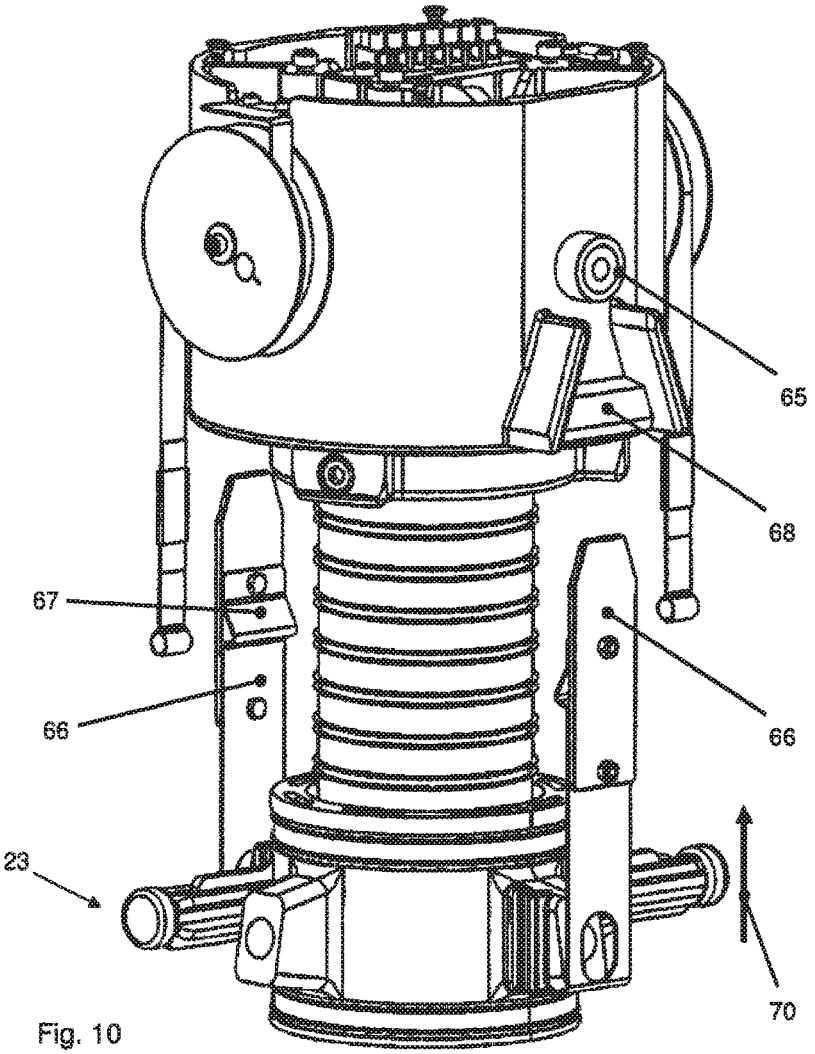
FIG. 10 is a perspective view of a further embodiment of the invention.
Figure 12:
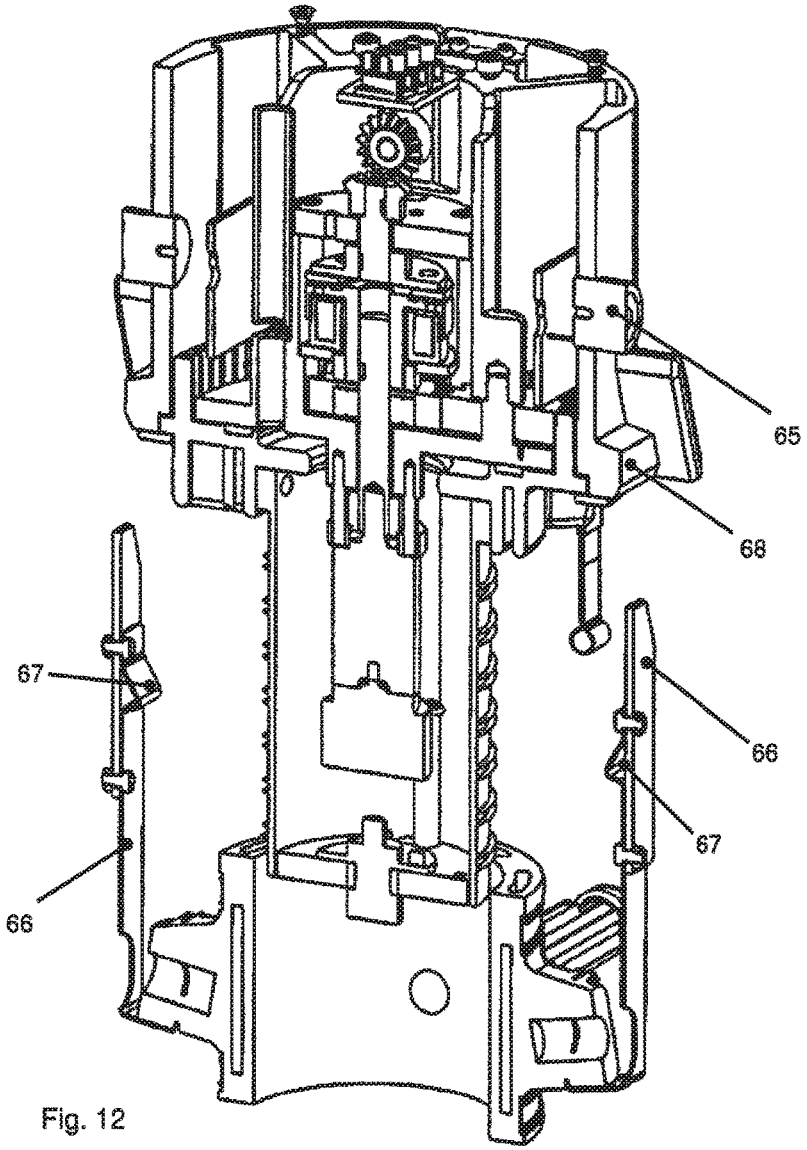
FIG. 12 is a section through a further embodiment of the invention.
Figure 13:
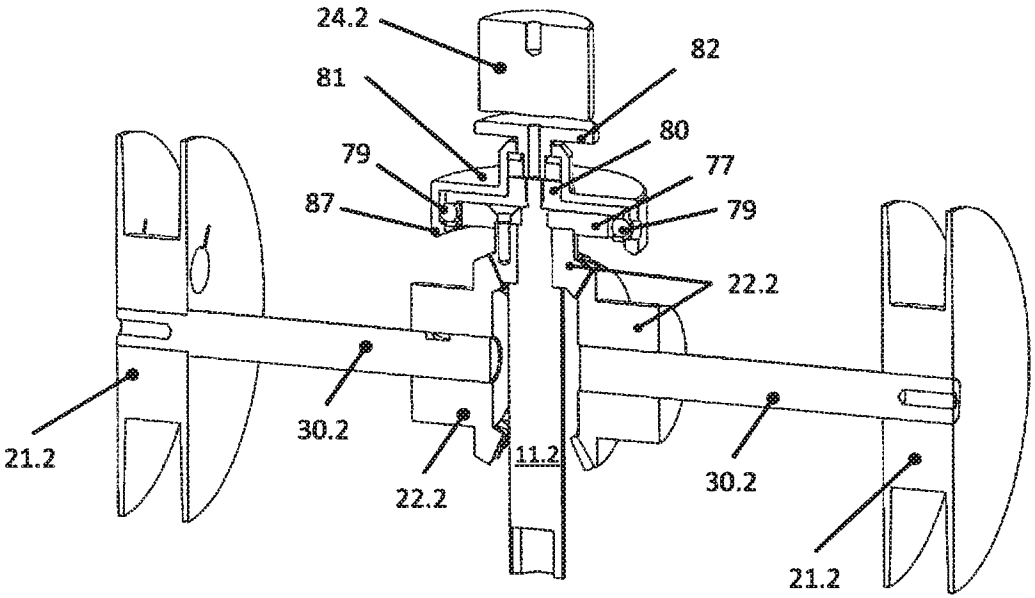
FIG. 13 is a section through a partial view of an alternative embodiment of a drive unit.
Figure 14:
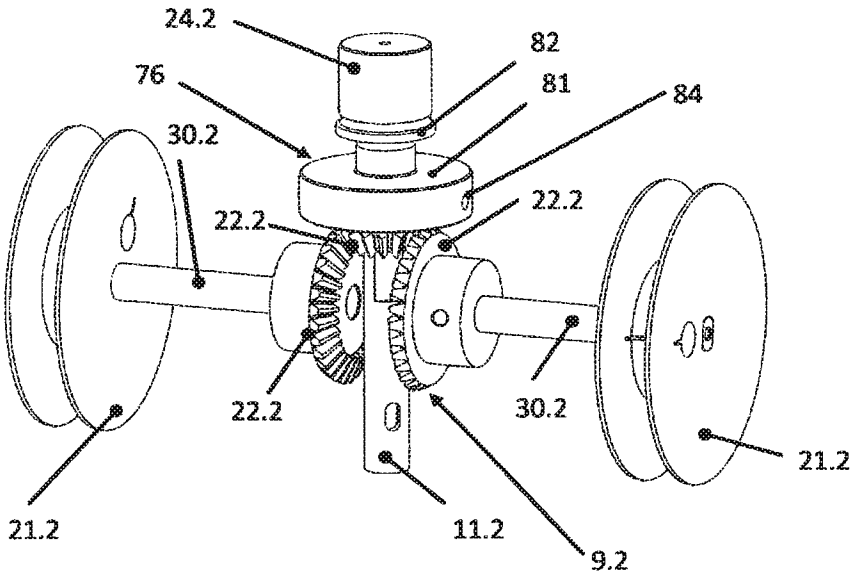
FIG. 14 is a perspective view in accordance with FIG. 14 [sic].

FIG. 10 and FIG. 12 show grid sheet metal 66 with noses 67 in addition to ramps 68 and electromagnets 65.

Figure 11:
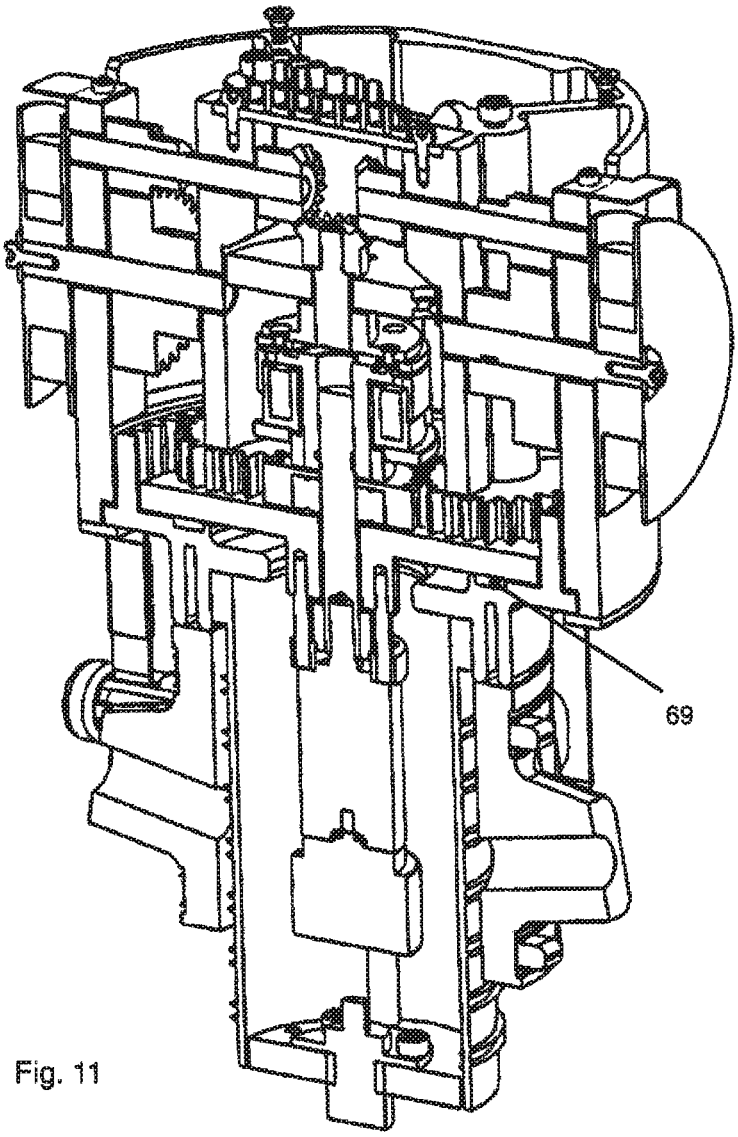
FIG. 11 is a section through a further embodiment of the invention.

FIG. 11 clearly shows a plain bearing 69.

With reference to FIGS. 1 to 12, the functionality of the mechanism in accordance with the invention can be explained as follows:

As shown in FIGS. 1, 2, 3 and 8, the rotating mechanism 49 serves on the one hand to fix the round flag 7 to the mast 2. In order to do this, the rotating mechanism 49 is first fixed to a mast 2 for a flag. The round flag 7 is then connected to the fixing device 50 on the side on which the rotating mechanism is arranged with the help of the fixing device 48 on the advertising space side. In order to create this connection, the two rings 61 held together by retaining clamps 55 are opened at one point. It is expedient if, in order to do this, retaining clamps 55 which are screws in or connected in another reversible manner are provided in addition to the welded retaining clamps 55. The rings 61 are preferably opened at a point at which two retaining clamps 55 in a pair arranged adjacent to one another and reversibly connected to one another are provided. The rings 61 are not closed, but rather each have two end sections 71 which face one another. The two retaining clamps 55 which are reversibly connected to one another are each assigned to an end section 71.

In order to connect the round flag 7 to the fixing device 50, the connection between the retaining clamps 55 which are reversibly connected to one another is broken. Starting with the end sections 71, the round flag 7 is then connected to the fixing device 50 by means of the round flag 7 being pushed between the two rings 61 such that the round flag is prevented from sliding between the rings 61 by the hose 53 and the round flag 7 is therefore securely mounted in the fixing device 50. The rings 61 are then fixed again by means of the retaining clamps 55 which are to be reversibly connected to one another. The cloth 7 is fixed to the rotating mechanism 49 by the largest diameter D of the fixing device 48 on the advertising space side being chosen to be larger than the gap 54. The cloth 7, the advertising space side of which has a fixing device 48 with loops 52 on both ends, is fixed to both fixing devices 50 on the side on which the rotating mechanism is arranged in the manner described above.

In addition to a hose 53 other means can be considered for this which are suitable to fix the cloth 7 to the rotating mechanism 49 as described above.

If the cloth is clamped in the fixing device 50 which is assigned to the lower lifting part 62 and is on the side on which the rotating mechanism is arranged shown in FIG. 9, the cloth will be stretched as a result of the new weight of the lower lifting part 62. In order to do this, the receiving ring 43 of the lower lifting part 62 is mounted in a sliding manner on the mast 2. The dimensions of the cloth are further selected such that the receiving ring 43 of the lower lifting part when hoisted is at a distance A from the retaining ring 51. The net weight of the lower lifting part 62 is therefore the sole weight acting on the cloth, streamlining the cloth.

The functionality of the rotating mechanism 49 with the rotating, hoisting and dropping function can be derived from FIGS. 3 to 7. The drive unit 8 of the rotating mechanism 49 is fixed to the upper end of the mast 2. The upper end of said mast bears a wind gauge. When hoisted, the upper lifting part 23 lies on the drive unit 8. As shown in FIG. 6, this places the electromagnetic clamps 24 in direct contact with the upper lifting part 23 and the pins 45 mesh with the pin recesses 60. This means that the upper lifting part 23 is held in the correct position relative to the drive unit 8. The rotating function, which is active when the flag is hoisted, is enabled by means of a transfer of a motor torque to the web 17 by means of the planet wheels of the planet gear 15. The roll mount 29 and the web 17 both rotate, and when hoisted the round flag 7 also rotates. The reason for this is the fact that the upper end of said round flag is connected to the upper lifting part 23 by the struts 46, which in turn are connected to the drive unit 8 in a torsion-protected manner when the flag is hoisted by means of the electromagnetic clamps 24 and the meshing of the pins 45.

The rotating function is only active when the direction of motor rotation is selected in which the freewheel bearing 14 inside the sun wheel 13 is blocked. If the other direction of motor rotation is selected, the freewheel bearing 14 enables a rotation of the motor shaft 11 without the sun wheel 13 being rotated.

Furthermore, the electromagnetic coupling 10 and the ball catch 76 are not closed while the rotating function is active. This means there is no torque transmission from the motor shaft 11 to the coupling shaft 16 or from the motor shaft 11.2 to the ball mount 80. As shown below, this torque transmission would cause a rotation of the drive shafts 30, 30.2 of the rolls 21, 21.2. If the wind gauge 6 registers that a pre-set threshold value has been exceeded, the dropping function is activated. Stopping the electric motor 4 stops the rotation of the motor shaft 11, resulting in a cessation of torque transmission to one of the gears 9, 15. The electromagnetic clamps 24 are switched off, resulting in the upper lifting part 23 sliding down the mast 2 as a result of its own weight. The lower lifting part 62 also slides downwards and comes to a stop on the retaining ring 51. The upper lifting part 23 comes to a stop on the lower lifting part 62. The round flag 7 which is fixed to the two lifting parts 23, 62 is therefore lowered and stored in a manner protected from the wind following a successful drop.

If the wind gauge 6 registers that the wind has fallen below a pre-set threshold value, the hoisting function is activated. The electric motor 4 is activated, rotating in the direction in which the freewheel bearing 14 is not blocked. This means there is no torque transmission via the planet gears 15 and no rotation. However, the electromagnetic coupling 10 and the ball catch 76 are closed, so the torque of the motor shaft 11 or 11.2 is transferred to the coupling shaft 16 or to the ball mount 80. As shown below, torque transmission to the rolls 21 occurs via the bevel gears 9. Both tapes 20 are therefore rolled up, whereby as a result of the attachment of the end of the tape 20 not mounted on the roll 21 to the mounting 47 the upper lifting part 23 is hoisted up the mast 2.

It should be noted that a lowering or shortening function can for example be provided by hoisting the lower lifting part 62, as lifting the lower lifting part 62 results in a reduction of the area of the advertising or information medium 1 which is exposed to the wind.

In accordance with the embodiment shown in FIG. 6, there is torque transmission from the motor shaft 11 to the rolls 21 when the electromagnetic coupling 10 is closed. The rotation of the motor shaft 11 then causes a rotation of the coupling shaft 16, which lies on the end of the bevel wheel 22. The rotation of the bevel wheel 22 which lies on the coupling shaft 16 in turn causes a rotation of the two bevel wheels 22 which lie on the ends of the two drive shafts 30. The torque is transferred to the shafts 57 and therefore to the rolls 21 mounted on the ends of the shafts 57 by means of gear wheels 58, 59.

In accordance with the alternative embodiment shown in FIGS. 13 to 16, torque transmission also occurs from the motor shaft 11.2 to the rolls 21.2 when the ball catch 76, which in accordance with the embodiment shown in FIGS. 13 to 16 replaces the function of the electromagnetic coupling, is closed. As can be seen from the comparison of FIGS. 15*a* and 15*b*, the torsion plate 82 which is in operative connection with the anchor 81 lies on the electromagnets 24.2 when closed as a result of the action of force. The torsion plate 82 is preferably connected to the anchor 81 in a in a freely rotating manner. Opposite the position shown in FIG. 15*b*, the electromagnet 24.2 causes the torsion plate, and along with it the anchor 81 move towards the electromagnets 24.2 in the direction of the arrow 86. A form fit between the torsion plate 82 and the anchor 81 causes the action of the force of the electromagnets 24.2 on the torsion plate 82 to also cause a movement of the anchor 81 in the direction of the arrow 86.

Figures 15A, 15B:
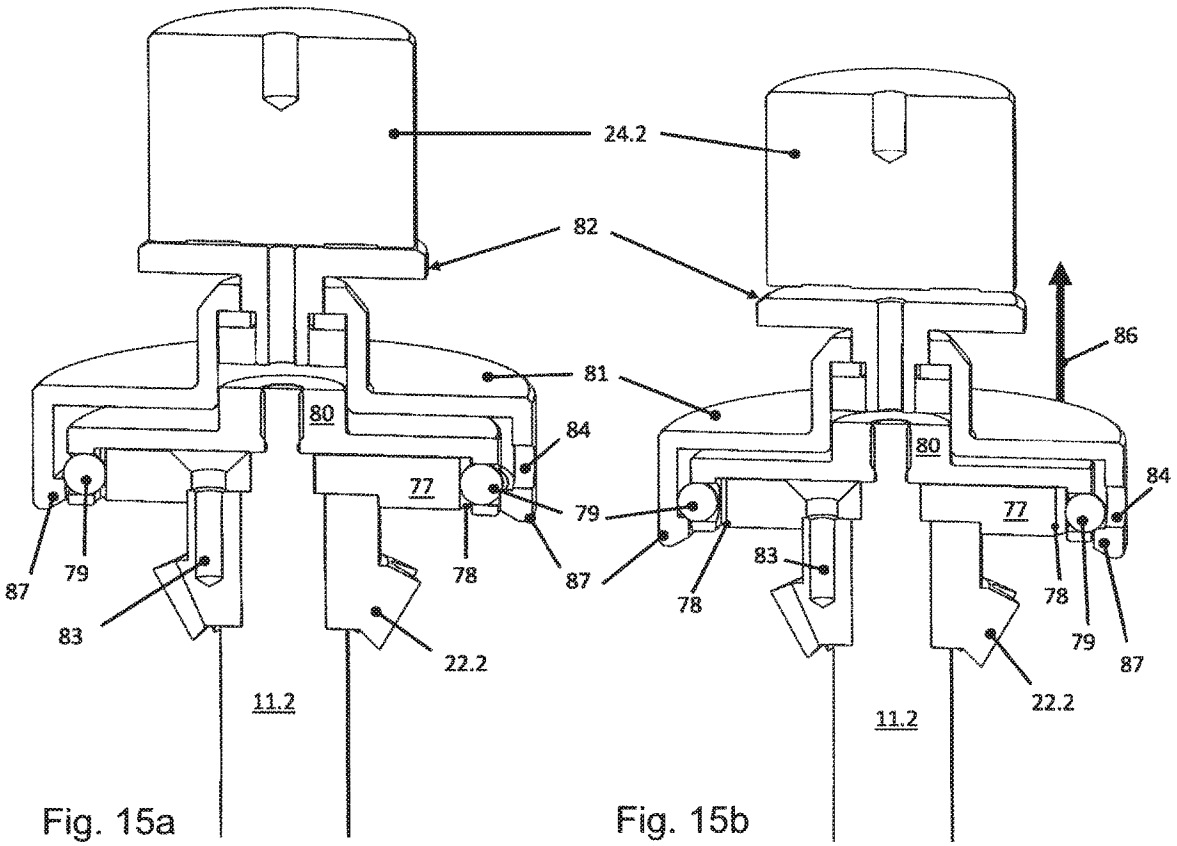
FIG. 15*a* is a section through an arrangement comprising a motor shaft 11.2, a ball catch 76 and an electromagnetic clamp 24.2 when closed.
FIG. 15*b* is an arrangement in accordance with FIG. 15*a* when open.
Figure 16:
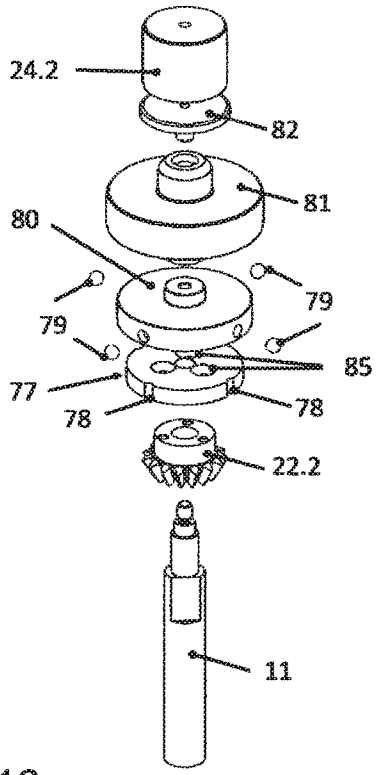
FIG. 16 is an exploded view in accordance with FIG. 15.

When open, as shown in FIG. 15*b*, there is no torque transmission from the motor shaft 11.2 to the bevel wheel 22.2. The ball mount 80 is connected, for example screwed, to the motor shaft 11.2, and rotates along with it. However, there is no positive locking connection between the ball mount 80 and the ring adapter 77. The ring adapter 77 therefore remains open. When open, the balls 79 carried along by the ball mount 80 are not in a position to create a connection between the ball mount 80 and the ring adapter 79 [sic], as they are able to avoid the motor shaft 11.2 by moving in a radial outward direction due to their intended central longitudinal axis rather than coming to a stop in the ball pans 78. This avoidance of the balls 79 is made still easier by the recesses 84. However, it is also possible to do without the recesses 84.

When open as shown in FIG. 15*a*, the balls 79 cannot move in a radial outward direction or into the recesses 84. Rather, the balls are held in the ring pans 79 by the overhang 87. In this way, the ball mount 80 creates a positive locking connection with the ring adapter 77, which is conveyed into the ball pans 78 by the balls 79.

When closed, a rotation of the motor shaft 11.2 therefore causes a rotation of the ring adapter 77. In turn, the ring adapter 77 is connected to the bevel wheel 22.2 by means of one or more screws 83, which bevel wheel 22.2 therefore also rotates along with the motor shaft 11.2 when closed.

The action of force, which is transferred to the balls 79 by the overhang 87 and the latter of which drives the ball pans 78 when closed, can be affected by a selected position of the torsion plate 82 or the anchor 81 along the direction of the arrow 86. By selecting a position appropriately at which the ball 79 with which the overhang 87 makes contact, the action of the force on the ball 79 can be selected to be greater or smaller.

FIGS. 10 and 12 show the function of the grid sheet metal. If the upper lifting part 23 moves in the direction of an arrow 70, a nose 67 of the grid sheet metal is guided over a ramp 68. After passing the ramp, the grid sheet metal is held in position by a magnet 65.

FIG. 11 shows a device having a plain bearing 69.

The invention claimed is:

1. A mechanism for the rotation of an element having advertising or information medium (1) thereon, comprising:

an element having advertising or information medium (1) thereon, and a dropping mechanism associated with the element wherein the element is dropped following an activation of the dropping mechanism wherein the element comprises a flag and rings for holding the flag in a round tubular form having open ends, the rings being positioned at the open ends, and further including a hoisting mechanism, wherein the hoisting mechanism includes a single drive unit (8), wherein the drive unit (8) comprises:

an electric motor (4) having a motor shaft (11) which interacts with or is connected to a first gear part;

an electromagnetic coupling (10) or a ball catch (76) which is provided to connect the motor shaft (11) to a coupling shaft (16), whereby this coupling shaft (16) interacts with or is connected to a second gear part;

a first gear comprising the first gear part, whereby rotation of the element is achieved by means of this first gear; and a second gear comprising the second gear part, whereby hoisting of the element is achieved by means of this second gear.

2. A mechanism in accordance with claim 1, wherein, when the dropping mechanism is activated, dropping of the element is a function of the net weight of the element having advertising or information medium (1).

3. A mechanism in accordance with claim 1, wherein the dropping mechanism takes place by means of a lowering or shortening function.

4. A mechanism in accordance with claim 1, further including a sensor (6) to activate the dropping and/or the hoisting mechanism.

5. A mechanism in accordance with claim 1, wherein the dropping mechanism is activated by means of a switching off or release of an element which is keeping the element with advertising or information medium (1) in a hoisted condition, wherein the means is an electromagnetic clamp (24).

6. A mechanism in accordance with claim 1, wherein while the hoisting mechanism is active a positional measurement of the element with advertising or information medium (1) is provided such that the hoisting is active until the element has reached a certain height.

7. A mechanism in accordance with claim 1, wherein the first gear is an epicyclic gear (15) and the first gear part is a sun wheel, and in that the second gear is a bevel gear (9) and the second gear part is a bevel (22), whereby the second gear is connected to the motor shaft (11) by means of the electromagnetic coupling (10).

8. A mechanism in accordance with claim 7, wherein a freewheel bearing (14) is shaped into the sun wheel (13) such that the sun wheel (13) is only moved in the direction of rotation of the motor shaft (11).

9. A mechanism in accordance with claim 1, further comprising a flag pole, and wherein the element is movably mounted to the flag pole through the rings.

10. A mechanism in accordance with claim 1, wherein the dropping mechanism is activated by means of a switching off or release of an element which is keeping the element with advertising or information medium (1) in a hoisted condition, wherein the element comprises a directly or indirectly controllable holding device (65).

* * * * *